US008591017B2

(12) United States Patent
Ito

(10) Patent No.: US 8,591,017 B2
(45) Date of Patent: Nov. 26, 2013

(54) LIQUID EJECTING HEAD

(75) Inventor: Takashi Ito, Nagoya (JP)

(73) Assignee: Brother Kogyo Kabushiki Kaisha, Nagoya-shi Aichi-ken (JP)

( * ) Notice: Subject to any disclaimer, the term of this patent is extended or adjusted under 35 U.S.C. 154(b) by 250 days.

(21) Appl. No.: 13/007,133

(22) Filed: Jan. 14, 2011

(65) Prior Publication Data

US 2011/0199444 A1 Aug. 18, 2011

(30) Foreign Application Priority Data

Feb. 15, 2010 (JP) ..... 2010-029799

(51) Int. Cl.
*B41J 2/175* (2006.01)

(52) U.S. Cl.
USPC ..... 347/93; 210/94; 347/7; 347/85; 347/86; 347/92; 347/94

(58) Field of Classification Search
None
See application file for complete search history.

(56) References Cited

U.S. PATENT DOCUMENTS

| | | | | |
|---|---|---|---|---|
| 6,158,855 | A * | 12/2000 | Saikawa | 347/93 |
| 7,837,315 | B2 * | 11/2010 | Mizutani et al. | 347/93 |
| 2002/0057320 | A1 | 5/2002 | Kaga et al. | |
| 2004/0263596 | A1 | 12/2004 | Watanabe et al. | |
| 2006/0164477 | A1 | 7/2006 | Fujii et al. | |
| 2007/0120913 | A1 * | 5/2007 | Mukai et al. | 347/93 |
| 2007/0229602 | A1 | 10/2007 | Taira et al. | |
| 2007/0229634 | A1 | 10/2007 | Chikamoto et al. | |
| 2008/0239040 | A1 | 10/2008 | Umeda | |

FOREIGN PATENT DOCUMENTS

| | | | |
|---|---|---|---|
| JP | H03-205157 | A | 9/1991 |
| JP | H09-141890 | A | 6/1997 |
| JP | H10-329330 | A | 12/1998 |
| JP | 2002-172801 | A | 6/2002 |
| JP | 2005-014315 | A | 1/2005 |
| JP | 2006-198960 | A | 8/2006 |
| JP | 2007-268829 | A | 10/2007 |
| JP | 2007-268868 | A | 10/2007 |
| JP | 2007-301799 | A | 11/2007 |
| JP | 2008-238584 | A | 10/2008 |

OTHER PUBLICATIONS

Japan Patent Office, Notification of Reasons for Refusal for Japanese Patent Application No. 2010-029799 (counterpart to above-captioned patent application), dispatched Feb. 21, 2012.

* cited by examiner

*Primary Examiner* — Matthew Luu
*Assistant Examiner* — John P Zimmermann
(74) *Attorney, Agent, or Firm* — Baker Botts L.L.P.

(57) ABSTRACT

A liquid ejecting head having a liquid-flow space through which a liquid flows from a liquid supply source toward liquid-drop ejecting nozzles, a generally planar partition portion extending in a direction intersecting a vertical direction and partially defining the liquid-flow space, and further partially defining first and second chambers such that the two chambers are arranged in a horizontal direction on respective opposite sides of the partition wall, the first and second chambers having a larger dimension in the vertical direction than in the horizontal direction, in cross section taken in a plane parallel to the vertical direction and a direction of arrangement of the two chambers, and a planar filter fixed to the partition portion so as to extend in a direction intersecting the horizontal direction, along a surface of the partition portion and configured to capture foreign matters contained in the liquid in at least one of the two chambers.

15 Claims, 8 Drawing Sheets

LIQUID EJECTING HEAD

CROSS REFERENCE TO RELATED APPLICATION

The present application claims the priority from Japanese Patent Applications No. 2010-029799 filed Feb. 15, 2010, the disclosure of which is herein incorporated by reference in its entirety.

BACKGROUND OF THE INVENTION

1. Field of the Invention

The present invention relates to a liquid ejecting head configured to eject droplets of a liquid such as an ink.

2. Description of Related Art

There is known an ink-jet head as an example of a liquid ejecting head, which includes a reservoir unit that temporarily stores an ink to be supplied from an ink tank and delivered to ink-ejecting nozzles. This reservoir unit includes a horizontally extending film, an inlet joint formed at one end of the film, and a filter disposed so as to extend in parallel to the film, and has a reservoir passage, a central communication hole in communication with the reservoir passage, and ink flow passages formed such that the ink which has entered into the reservoir unit through the inlet joint flows horizontally, then flows upwards through the filter, and then flows downwards into the reservoir passage through the central communication hole. The reservoir passage has a comparatively large surface area in cross section taken in a horizontal plane parallel to the film.

SUMMARY OF THE INVENTION

The filter unit having the filter disposed so as to extend horizontally as described above tends to have a relatively large size in the horizontal plane if the filter is formed to have the cross sectional surface area large enough to effectively perform its filtering function to capture foreign matters such as air bubbles contained in the ink, and accordingly results in an undesirable increase in the size of the ink-jet head in the horizontal plane.

The reservoir unit described above suffers from another problem, that is, a problem of clogging of the filter with the captured foreign matters scattered over a comparatively large surface area in the horizontal plane. The clogging of the filter leads to a decrease in the effective surface area of the filter (surface area effective to capture the foreign matters), an increase in the ink flow resistance of the filter, and a consequent decrease of the rate of flow of the ink to the nozzles of the ink-jet head, eventually resulting in a failure of normal ejection of the ink from the nozzles. Since the filter is likely to be clogged over the relatively large surface area as described above, an ink circulation purging operation of the ink-jet head to cause positive flows of the ink along the filtering surface of the filter should be performed frequently, so that the efficiency of a printing operation of the ink-jet head tends to be lowered.

The present invention was made in view of the background art described above. It is therefore an object of the present invention to provide a liquid ejecting head which is configured to reduce its size in the horizontal plane and to reduce a chance of clogging of its filter with the foreign matters over a large surface area.

The object indicated above can be achieved according to the principle of this invention, which provides a liquid ejecting head comprising:

a structure defining a liquid-flow space through which a liquid flows from a liquid supply source toward a plurality of liquid-drop ejecting nozzles; a generally planar partition portion formed so as to extend in a direction intersecting a vertical direction and configured to partially define the liquid-flow space; the partition portion partially defining a first chamber and a second chamber such that the first and second chamber are arranged in a horizontal direction on respective opposite sides of the partition wall, the first and second chambers having a larger dimension in the vertical direction than that in the horizontal direction, in cross section taken in a plane parallel to the vertical direction and the horizontal direction of arrangement of the first and second chambers; and a planar filter fixed to the partition portion so as to extend in a direction intersecting the horizontal direction, along a surface of the partition portion, and configured to capture foreign matters contained in the liquid in at least one of the first and second chambers.

BRIEF DESCRIPTION OF THE DRAWINGS

The above and other objects, features, advantages and technical and industrial significance of the present invention will be better understood by reading the following detailed description of a preferred embodiment of the present invention, when considered in connection with the accompanying drawings, in which:

FIGS. 5A, 5B and 5C are views indicating ink flows through the ink-jet head of FIG. 1 during a printing operation of the ink-jet head, wherein FIG. 5A is a fragmentary cross sectional view of a first chamber of a filter unit, and FIG. 5B is a fragmentary cross sectional view of a second chamber of the filter unit, while FIG. 5C is a fragmentary exploded perspective view of the filter unit and a reservoir unit;

FIGS. 6A, 6B and 6C are views indicating ink flows through the ink-jet head of FIG. 1 during a nozzle purging operation of the ink-jet head, wherein FIG. 6A is a fragmentary cross sectional view of the second chamber of the filter unit, and FIG. 6B is a fragmentary cross sectional view of the first chamber of the filter unit, while FIG. 6C is a fragmentary exploded perspective view of the filter unit and the reservoir unit;

FIGS. 7A and 7B are views indicating ink flows through the ink-jet head of FIG. 1 during a circulation purging operation of the ink-jet head, wherein FIG. 7A is a fragmentary cross sectional view of the second chamber of the filter unit, and FIG. 6B is a fragmentary cross sectional view of the first chamber of the filter unit; and FIGS. 8A, 8B and 8C are views indicating ink flows through the ink-jet head of FIG. 1 during an inter-filter purging operation of the ink-jet head, wherein FIG. 8A is a fragmentary cross sectional view of the second chamber of the filter unit, and FIG. 8B is a fragmentary cross sectional view of the first chamber of the filter unit, while FIG. 8C is a fragmentary exploded perspective view of the filter unit and the reservoir unit.

DETAILED DESCRIPTION OF THE PREFERRED EMBODIMENTS

The preferred embodiment of this invention will be described by reference to the accompanying drawings.

Figure 1:
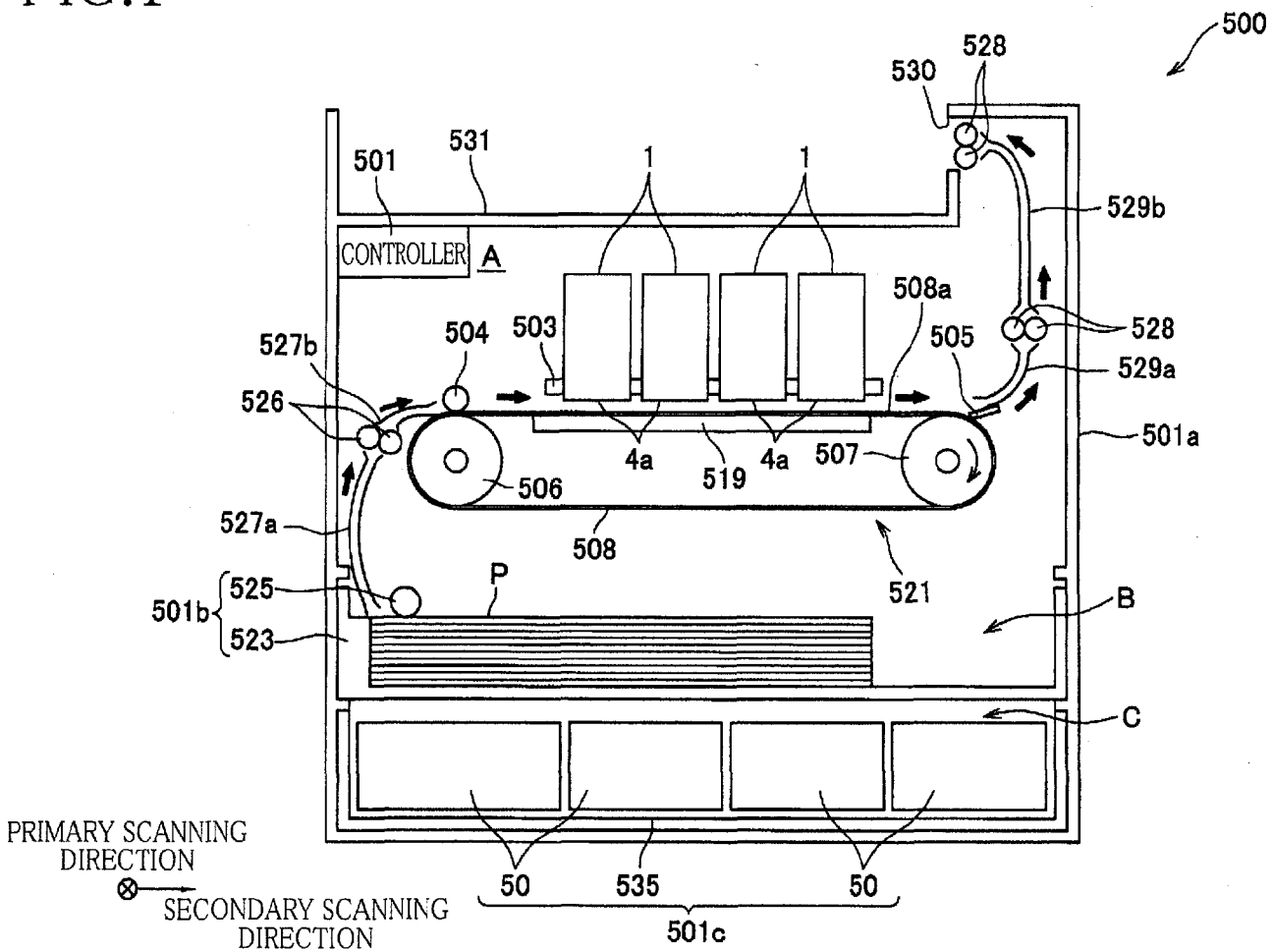
FIG. 1 is a schematic side elevational view of an ink-jet type printer including an ink-jet head as a liquid ejecting head constructed according to a first embodiment of this invention.

Referring first to the schematic side elevational view of FIG. 1, there is shown a printer 500 of an ink-jet type including four ink-jet heads 1 each constructed as a liquid ejecting head constructed according to the preferred embodiment of the present invention. Each of the ink-jet heads 1 is a so-called "line printing head" disposed so as to extend in one direction (direction perpendicular to the plane of the view of FIG. 1). That is, each ink-jet head 1 has its longitudinal direction that is a primary scanning direction, which is perpendicular to a secondary scanning direction in which the four ink-jet heads 1 are arranged in the ink-jet printer 500 of the line printing type.

The printer 500 has a housing 501*a* in the form of a generally rectangular parallelepiped having a top wall that serves as a sheet receiver 531. The housing 501*a* has three functional spaces A, B and C arranged in the order of description in the downward direction. A sheet transfer path along which a sheet of paper P is fed is formed through the functional spaces A and B and leads to the sheet receiver 531. In the functional space A, printing operations of the ink-jet heads 1 to print images on the paper sheet P are performed. In the functional space B, the paper sheets P are supplied one after another from a sheet supply tray 523 of a sheet supply unit 501*b*. In the functional space C, four ink cartridges (main tanks) 50 are disposed as ink supply sources.

In the functional space A, there are disposed the above-described four ink-jet heads 1, a sheet transfer unit 521, and sheet guide devices for guiding the paper sheet P. In an upper part of the functional space A, there is disposed a controller 501 for controlling operations of various devices of the printer 500.

Each ink-jet head 1 has a housing in the form of a generally rectangular parallelepiped the longitudinal direction of which is parallel to the primary scanning direction. The housing 501*a* has a head frame 503 supporting the four ink-jet heads 1 such that the four ink-jet heads 1 are arranged at a predetermined pitch in the secondary scanning direction. The four ink-jet heads 1 are supplied with respective four colors of ink, namely, magenta, cyan, yellow and black inks, as described below, and are configured to eject droplets of the respective colors of ink from their lower surfaces (ink ejecting surfaces) 4*a* toward the paper sheet P. The construction of each ink-jet head 1 will be described in more detail.

The sheet transfer unit 521 includes two belt rollers 506, 507, an endless conveyor belt 508 connecting the two belt rollers 506, 507, a nip roller 504 disposed adjacent to the belt roller 506, a sheet separator plate 505 disposed adjacent to the belt roller 507, and a platen 519 disposed within the loop of the conveyor belt 508. The belt roller 507 is a drive roller rotated clockwise as seen in FIG. 1 by a belt drive motor (not shown) under the control of the controller 501. As a result of the clockwise rotation of the belt roller 507, the upper span of the conveyor belt 508 is moved rightwards as indicated by arrows in FIG. 1. The belt roller 506 is a driven roller rotated clockwise as the conveyor belt 508 is rotated by the belt roller 507. The nip roller 504 cooperates with the belt roller 506 to press the paper sheet P onto an outer surface 508*a* of the conveyor belt 508 as the paper sheet P is fed from an upstream sheet guide device (described below). The outer surface 508*a* is coated with a slightly adhesive silicone layer. The sheet separator plate 505 disposed adjacent to the belt roller 507 functions to separate the paper sheet P from the outer surface 508*a*, so that the paper sheet P is fed toward a downstream sheet guide device (described below). The platen 519 is disposed below and in opposition to the four ink-jet heads 1, and functions to support the upper span of the conveyor belt 508 on its inner surface, so that a suitable amount of gap required to permit desired image forming operations of the ink-jet heads 1 is maintained between the outer surface 508*a* and the ink ejecting surfaces 4*a* of the ink-jet heads 1.

The upstream and downstream sheet guide devices are disposed on the respective opposite sides of the sheet transfer unit 521. The upstream sheet guide device includes two guides 527*a*, 527*b*, and a pair of feed rollers 526, and functions to guide the paper sheet P from the above-indicated sheet supply unit 501*b* to the sheet transfer unit 521. The downstream sheet guide device includes two guides 529*a*, 529*b*, and a pair of feed roller 528, and functions to guide the paper sheet P from the sheet transfer unit 521 to the sheet receiver 531. One of the two feed rollers 526, and one of the two feed rollers 528 are driven by a sheet feed motor (not shown) under the control of the controller 501. The guides 527*a*, 527*b*, 529*a*, 529*b* are arranged to guide the paper sheet P to and from the pairs of rollers 526, 528.

In the functional space B, there is disposed the above-indicated sheet supply unit 501*b* such that the sheet supply unit 501*b* is removable from the housing 501*a*. The sheet supply unit 501*b* includes the above-indicated sheet supply tray 523 and a sheet supply roller 525. The sheet supply tray 23 is a box having an upper opening, and accommodates a stack of paper sheets P. The sheet supply roller 525 is driven by a sheet supply motor (not shown) under the control of the controller 501, to feed the uppermost paper sheet P of the stack toward the upstream sheet guide device.

In the functional spaces A and B, the sheet transfer path is formed so as to extend from the sheet supply unit 501*b* to the sheet receiver 531 through the sheet transfer unit 521. The sheet supply motor, sheet feed motor and belt drive motor described above are driven under the control of the controller 501 according to printing control commands, so that the uppermost paper sheet P is fed by the sheet supply roller 525 from the sheet supply tray 523, fed by the feed rollers 526 to the sheet transfer unit 521, and fed by the conveyor belt 508 under the ink ejecting surfaces 4*a* of the ink-jet heads 1 in the secondary scanning direction while the ink droplets are ejected from the ink ejecting surfaces 4*a*, whereby the desired color images are printed on the paper sheet P. Subsequently, the paper sheet P is separated by the sheet separator plate 505 from the outer surface 508*a* of the conveyor belt 508, and is fed upwards by the pair of feed rollers 528 while the paper sheet P is guided by the guides 529*a*, 529*b*, and is ejected onto the sheet receiver 531.

The secondary scanning direction is a horizontal direction parallel to the direction of feeding of the paper sheet p by the sheet transfer unit 521, while the primary scanning direction is a horizontal direction perpendicular to the secondary scanning direction.

In the functional space C, there is disposed an ink unit 501*c* such that the ink unit 501*c* is removable from the housing 501*a*. The ink unit 501*c* includes a tank tray 535, and the above-indicated four main tanks (ink cartridges) 50, which are respectively used for the four ink-jet heads 1 and are arranged in the tank tray 535 in the secondary scanning direction. The ink is supplied from each of the main tanks 50 through a tube to the corresponding ink-jet head 1.

Figure 2:
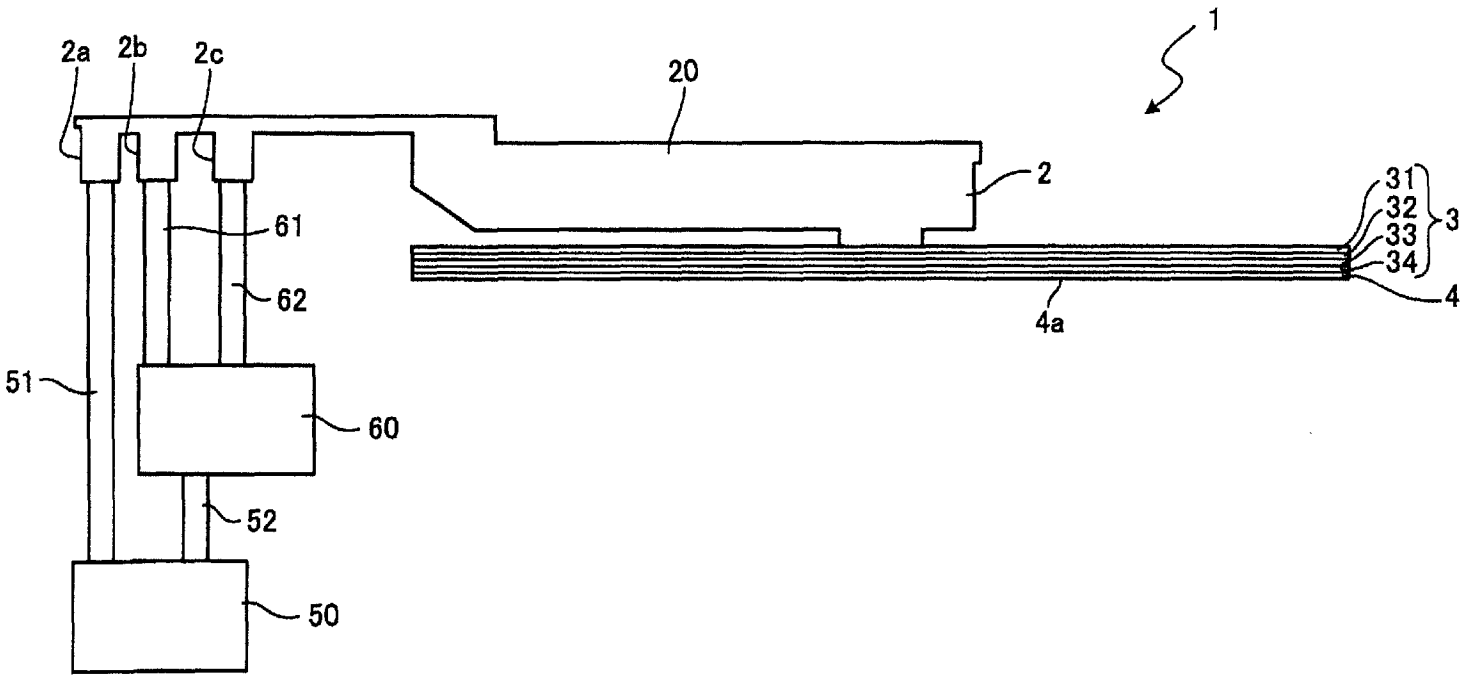
FIG. 2 is a side elevational view of the ink-jet head of FIG. 1.
Figure 3B:
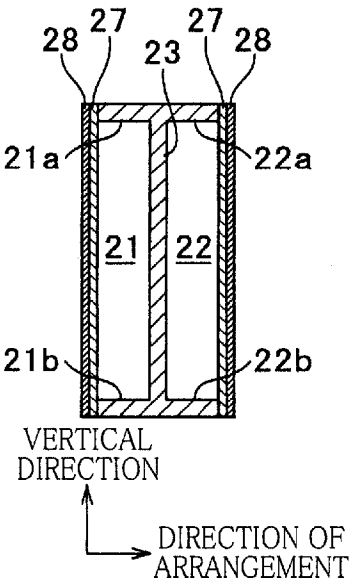
FIG. 3B is a cross sectional view taken along line B-B of FIG. 3A.
Figure 3A:
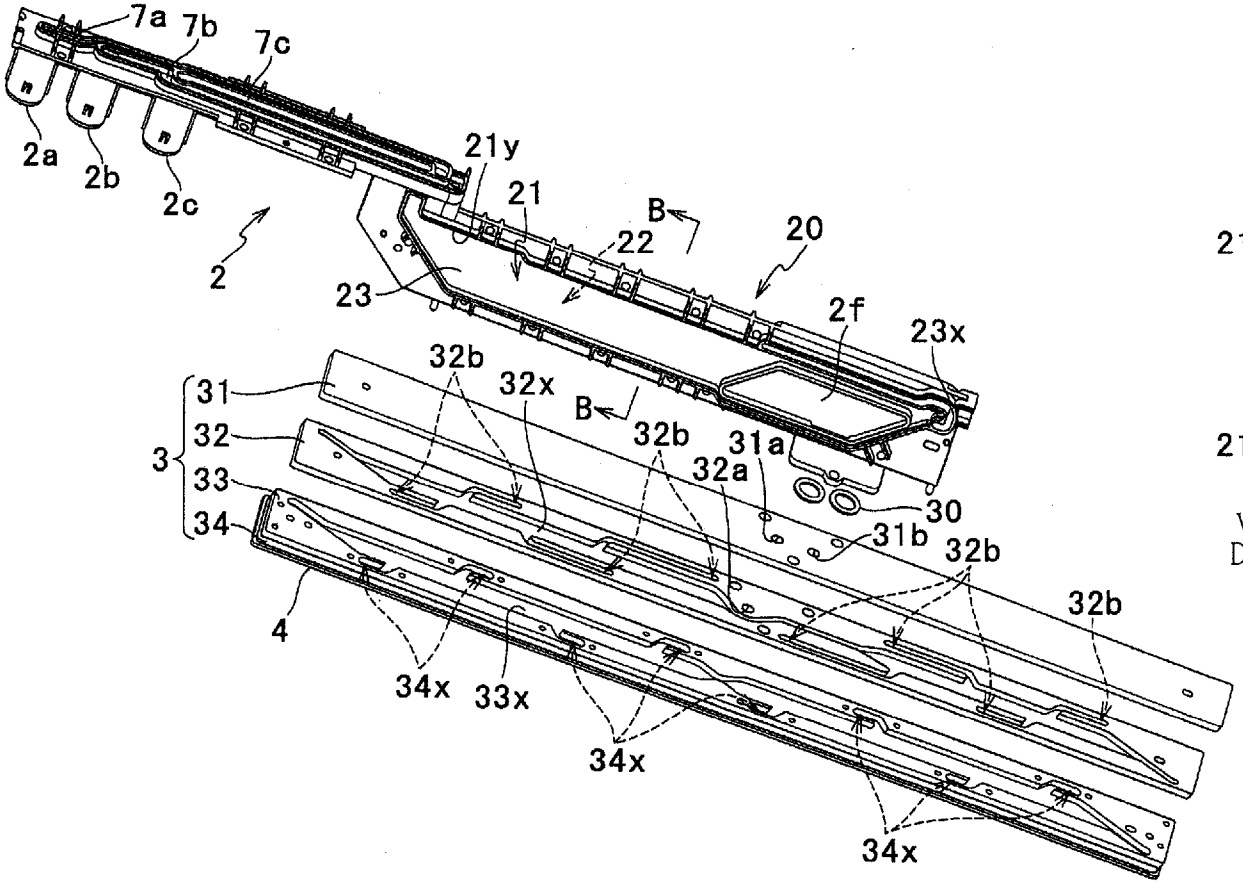
FIG. 3A is an exploded perspective of the ink-jet head of FIG. 1.
Figure 4:
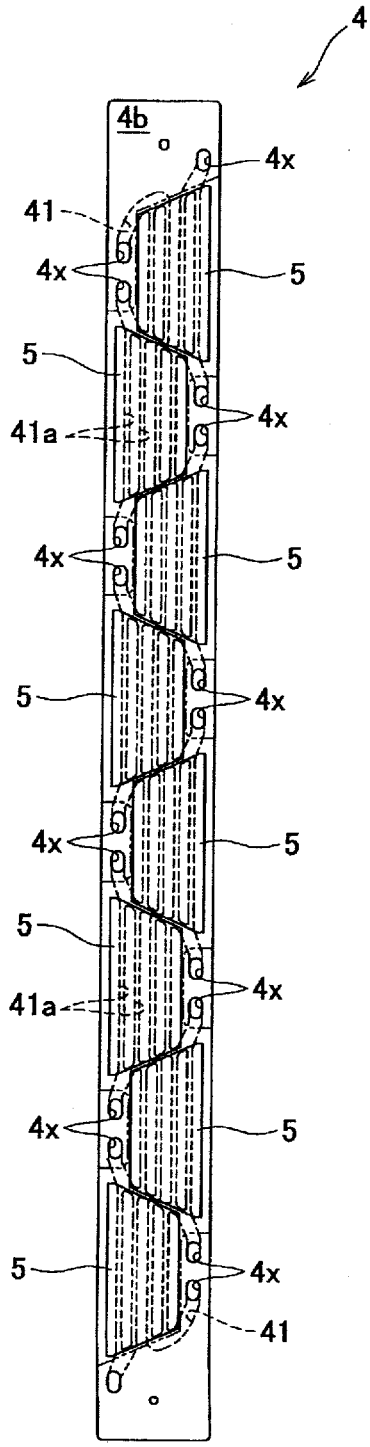
FIG. 4 is a plan view of a passage unit of the ink-jet head of FIG. 1.

Referring nest to FIGS. 2-4, the construction of each ink-jet head 1 will be described. As shown in FIG. 2, the ink-jet head 1 includes a filter unit 2, a reservoir unit 3 and a passage unit 4, which are arranged in the order of description in the downward direction.

The filter unit 2 is a one-piece structure formed of a suitable material such as a synthetic resin. The filter unit 2 has a base portion 20 including three inlet joints 2*a*, 2*b* and 2*c* formed at one of its longitudinal ends, and a filter 2*f* (shown in FIG. 3A) at the other longitudinal end. The inlet joints 2*a*-2*c* take the form of downwardly extending sleeves to which elastic tubes 51, 61 and 62 are respectively connected. The filter unit 2 is connected to the main tanks 50 and an auxiliary tank 60 through the inlet joints 2*a*-2*c* and elastic tubes 51, 61, 62.

The main and auxiliary tanks 50, 60 serve as a liquid supply source, which store an ink of a color corresponding to the ink-jet head 1, and are held in communication with each other through an elastic tube 52. The main tanks (ink cartridges) 50 are removably installed in the housing 501*a* of the printer 500, as shown in FIG. 1, and supply the auxiliary tank 60 with the ink, as needed. The auxiliary tank 60 has a hole open to the atmosphere, through which air bubbles contained in the ink are released into the atmosphere. The auxiliary tank 60 is disposed at a suitable position within the housing 501*a*. The elastic tubes 51, 52, 61, 62 are provided with valves and pumps, which are controlled by the controller 501 (shown in FIG. 1) during a printing operation or purging operations of the ink-jet head 1, to feed the ink from the tanks 50, 60 to the filter unit 2 through the elastic tubes 51, 52, 61 62 and inlet joints 2*a*-2*c*, or to return the ink containing the air bubbles, dusts and other foreign matters, from the filter unit 2 back to the tanks 50, 60 through the inlet joints 2*a*-2*c* and elastic tubes 51, 52, 61, 62.

The construction of the filter unit 2 and flows of the ink during the printing and purging operations of the ink-jet head 1 will be described below in detail.

The reservoir unit 3 is a laminar structure consisting of four rectangular metal plates 31, 32, 33 and 34 which have the same surface area as seen in the horizontal plane and which are bonded together. As shown in FIG. 3A, the reservoir unit 3 is fluid-tightly fixed to the filter unit 2 through two O-rings 30 formed of a rubber or other elastic material, and by means of suitable fixing means.

As also shown in FIG. 3A, each of the metal plates 31-34 of the reservoir unit 3 has through-holes and recesses for forming ink passages in the reservoir unit 3. Described more specifically, the uppermost metal plate 31 has two through-holes 31*a* and 31*b*, and the second metal plate 32 has a through-hole 32*a* communicating with the through-hole 31*a*, a recess 32*x* communicating with the through-hole 31*b*, and through-holes 32*b* formed in an end portion of each of branch grooves of the recess 32*x*. The through-hole 32*a* is held in communication with a reservoir 33*x* (described below), and the recess 32*x* is formed in the upper surface of the metal plate 32, so as to extend in the longitudinal direction of the ink-jet head 1, so that the ink containing the foreign matters flows through the recess 32*x* during an inter-filter purging operation of the ink-jet head 1, which will be described by reference to FIG. 8. The recesses 32*b* respectively communicate with the end portions of branch passages of the reservoir 33*x*. The third metal plate 33 has the above-indicated reservoir 33*x*, which temporarily stores the ink. The reservoir 33*x* is formed through the thickness of the third metal plate 33, so as to extend in the longitudinal direction of the ink-jet head 1. The end portions of the branch passages of the reservoir 33*x* are held in communication with the through-holes 32*b* formed in the end portions of the branch grooves of the recess 32 in the second metal plate 32 superposed on the third metal plate 33, and are aligned with respective through-holes 4*x* (shown in FIG. 4) formed through the passage unit 4 located below the third metal plate 33. The reservoir 33*x* are closed at its upper opening by the lower surface of the second metal plate 32, and at its lower opening by the upper surface of the fourth metal plate 34, except in the end portions of the branch passages of the reservoir 33*x*. The fourth metal plate 34 has through-holes 34*x* in communication with the above-indicated through-holes 4*x* formed through the passage unit 4, and with the end portions of the branch passages of the reservoir 33*x*.

As described above, the reservoir unit 32 has an ink passage through which the ink fed from the filter unit 2 flows to the through-holes 4*x* of the passage unit 4. During the printing operation (described below by reference to FIG. 5) and a nozzle purging operation (described below by reference to FIGS. 6A-6C) of the ink jet head 1, the ink flows from the filter unit 2 through the through-holes 31*a*, 32*a* into the reservoir 33*x*, more specifically, into the branch passages of the reservoir 33*x*, and flows into the through-holes 4*x* of the passage unit 4 through the through-holes 34*x*. During the inter-filter purging operation (described by reference to FIGS. 8A-8C) of the ink-jet head 1, the ink fed into the reservoir 34*x* through the through-hole 32*a* flows from the branch passages of the reservoir 34*x* into the recess 32*x* through the through-hole 32*b*, and then into the filter unit 2 through the through-hole 31*b*.

As shown in FIG. 4, the passage unit 4 has eight piezoelectric actuator units 5 each having a trapezoidal shape, which are arranged in two rows in a zigzag fashion on its upper surface 4*b*. The through-holes 4*x* described above are formed in surface areas of the passage unit 4 outside the surface areas of the actuator units 5. In the surface areas of a lower surface 4*a* (shown in FIG. 2) of the passage unit 4 which correspond to the respective surface areas of the actuator unit 5, a multiplicity of ink ejecting nozzles (not shown) serving as liquid-drop ejecting nozzles are open for ejecting the ink droplets. The passage unit 4 has main manifold passages 41 in communication with the through-holes 4*x*, auxiliary manifold passages 41*a* in communication with the main manifold passages 41, and individual ink passages for communication between the auxiliary manifold passages 41*a* and the ink ejecting nozzles. As is apparent from FIG. 4, the auxiliary manifold passages 41*a* branch from the main manifold passages 41 in the longitudinal direction of the ink-jet head 1.

The lowermost metal plate 34 of the reservoir unit 3 is bonded at its lower surface to the upper surface 4*b* of the passage unit 4, except in the areas of the actuator units 5 (the areas indicated by two-dot chain lines in FIG. 4, which areas include the spots in which the through-holes 4*x* are open) of the passage unit 4. That is, the lower surface of the metal plate 34 has raised portions in the areas in which the through-holes 34*x* are formed and which are opposed to the areas of the passage unit 4 indicated by the two-dot chain lines in FIG. 4), and recessed portions in the other areas. The end surfaces of the raised portions on the lower surface of the metal plate 34 are held in abutting contact with the upper surface 4*b* of the passage unit 4. The recessed portions on the lower surface of the metal plate 34 are spaced by a small amount of gap from the upper surface 4*b* of the passage unit 4, the surfaces of the actuator units 5 bonded to the upper surface 4*b*, and the surface of a flexible printed circuit (not shown) bonded to the surfaces of the actuator units 5.

Referring to FIGS. 3A and 3B and FIGS. 5A-5C, the construction of the filter unit 2 will be described in detail.

As shown in FIG. 3A, the filter unit 2 includes a connecting portion having three connecting passages 7*a*, 7*b* and 7*c* connecting the inlet joints 2*a*-2*c* to first and second chambers 21 and 22 provided in the base portion 20. The connecting passage 7*c* connects the inlet joint 2*c* to the first chamber 21 while the connecting passages 7*a* and 7*b* connect the inlet joints 2*a* and 2*b* to the second chamber 22. The upper walls of the connecting passages 7*a*-7*c* are laminar structures similar to a laminar structure consisting of a flexible film 27 and a metal sheet 28 (which will be described by reference to FIG. 3B). Namely, each of the connecting passages 7*a*-7*c* is fluid-tightly sealed at its upper opening by the flexible film backed by the metal sheet. The metal sheet functions to prevent an excessive amount of outward flexure of the flexible film.

An interior space within the base portion 20 is divided into the above-indicated first and second chambers 21, 22 by a partition wall 23 which extends in the vertical direction, with the ink-jet head 1 installed in the printer 500 such that the lower surface 4*a* of the passage unit 4 extends in the horizontal direction. As indicated in FIG. 3B, the first and second chambers 21, 22 are arranged in the horizontal direction on the respective opposite sides of the partition wall 23. Each of the first and second chambers 21, 22 has a rectangular shape in cross section taken in a vertical plane parallel to the vertical direction of extension of the partition wall 23 and the direction of arrangement of the chambers 21, 22, as indicated in FIG. 3B. The rectangle of this cross sectional shape has a larger dimension in the vertical direction than that in the horizontal direction. One of the opposite long sides of the rectangle is defined by the partition wall 23 while the other long side is defined by the laminar structure of the flexible film 27 and metal sheet 28. The metal sheet 28 functions to prevent an excessive amount of outward flexure of the flexible film 27 and direct exertion of an external force onto the flexible film 27. It is noted that the flexible film 27 and metal sheet 28 are not shown in FIG. 3A.

The first and second chambers 21, 22 are held in communication with each other through a communication passage 23*x* which is formed through the partition wall 23 and which is a through-hole having a substantially circular cross sectional shape, as shown in FIG. 3A. The communication passage 23*x* is formed through an upper end portion of the partition wall 23 and at one of longitudinally opposite ends of the partition wall 23 which is remote from the inlet joints 2*a*-2*c* in the horizontal direction perpendicular to the vertical direction of extension of the partition wall 23 and the direction of arrangement of the two chambers 21, 22.

Figure 5A:
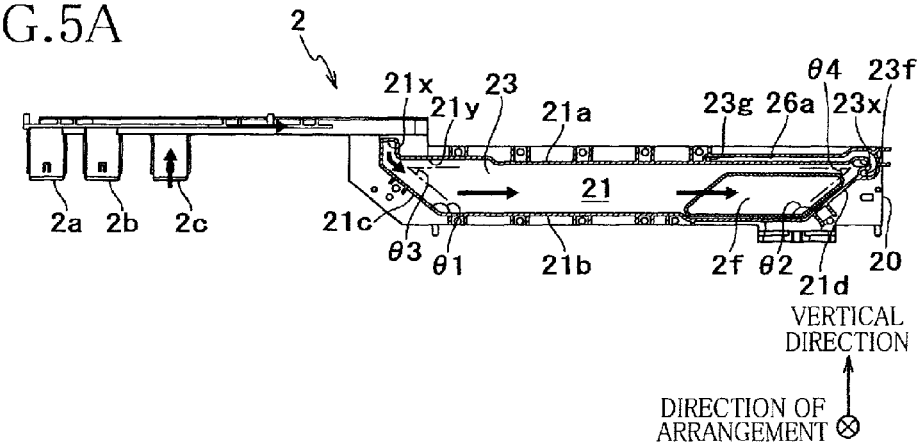

As shown in FIG. 5A, the first chamber 21 is partially defined by an upper wall 21*a* and a lower wall 21*b* both extending in the horizontal direction, and two end walls 21*c* and 21*d* which are inclined with respect to the vertical direction. The first chamber 21 has an inverted trapezoidal cross sectional shape as seen in the direction of arrangement of the two chambers 21, 22, as shown in FIG. 5A. An exhaust passage 26*a* is formed so as to surround the opening of the communication passage 23*a* on the side of the first chamber 21. The exhaust passage 26*a* is isolated from the first chamber 21 by a partition wall. The laminar structure of the flexible film 27 and metal sheet 28 (shown in FIG. 3B) is disposed in opposition to the partition wall 23 in the direction of arrangement of the two chambers 21, 22. The flexible film 27 of the laminar structure is fixed to the ends of the walls 21*a*-21*d* and the end of the side wall defining the exhaust passage 26*a*, such that the flexible film 27 partially defines the first chamber 21 and exhaust passage 26*a*.

The exhaust passage 26*a* is held in communication at its one end with an upper end portion of a filter chamber 29 (described below) through a through-hole 23*f*, and at the other end with an exhaust passage 26*b* (described below) through a through-hole 23*g*. The air bubbles accumulated in the upper portion of the filter chamber 29 are exhausted through the exhaust passage 26*a*.

Figure 5B:
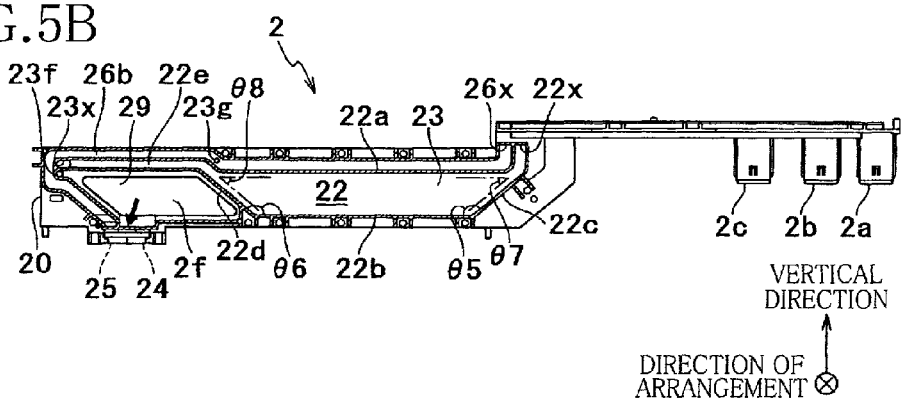

As shown in FIG. 5B, the second chamber 22 is partially defined by an upper wall 22*a* and a lower wall 22*b* both extending in the horizontal direction, and two end walls 22*c* and 22*d* which are inclined with respect to the vertical direction. The second chamber 22 includes a main space having an inverted trapezoidal cross sectional shape as seen in the direction of arrangement of the two chambers 21, 22, as shown in FIG. 5B, and further includes a passage 22*e* communicating with the main space. The passage 22*e* extends from a part of the main space adjacent to the upper portion of the end wall 22*d*, in the longitudinal direction of the base portion 20, and is located at a vertical position higher than that of the main space, as seen in the vertical direction. Below the passage 22*e*, there is formed the above-indicated filter chamber 29, with a partition wall existing between the passage 22*e* and the filter chamber 29. The above-indicated exhaust passage 26*b* is formed so as to surround the second chamber 22 and the filter chamber 29. The laminar structure of the flexible film 27 and metal sheet 28 (shown in FIG. 3B) partially defining the second chamber 22 is also disposed in opposition to the partition wall 23 in the direction of arrangement of the two chambers 21, 22. The flexible film 27 of the laminar structure is fixed to the ends of the walls 22*a*-22*d* and the ends of the side walls defining the passage 22*e*, filter chamber 29 and exhaust passage 26*b*, such that the flexible film 27 partially defines the second chamber 22, filter chamber 29 and exhaust passage 26*b*. The exhaust passage 26*b* is provided to discharge the ink fed from the reservoir 33*x* and exhaust passage 36*a*, out of the ink-jet head 1.

Regarding the first chamber 21 shown in FIG. 5A, an angle of inclination θ1 of the end wall 21*c* with respect to the lower wall 21*b*, and an angle of inclination θ2 of the end wall 21*d* with respect to the lower wall 21*b* are both obtuse angles (e.g. about 140 degrees), while an angle of inclination θ3 of the end wall 21*c* with respect to the upper wall 21*a*, and an angle of inclination θ4 of the end wall 21*d* with respect to the upper wall 21*a* are both are both acute angles (e.g. about 40 degrees). Regarding the second chamber 22 shown in FIG. 5B, an angle of inclination θ5 of the end wall 22*c* with respect to the lower wall 22*b*, and an angle of inclination θ6 of the end wall 22*d* with respect to the lower wall 22*b* are both obtuse angles (e.g. about 140 degrees), while an angle of inclination θ7 of the end wall 22*c* with respect to the upper wall 22*a*, and an angle of inclination θ8 of the end wall 22*d* with respect to the upper wall 22*a* are both acute angles (e.g. about 40 degrees).

The obtuse angles of inclination θ1, θ2, θ5, θ6 of the end walls 21*c*, 21*d*, 22*c*, 22*d* with respect to the lower walls 21*b*, 22*b* permit smooth substantially horizontal flows of the ink through the first and second chambers 21, 22 in the longitudinal direction, without dwelling of the ink in the lower corner portions of the chambers 21, 22, and also permit smooth substantially horizontal flows of the air bubbles together with the ink, without dwelling of the air bubbles within the chambers 21, 22.

The first chamber 21 has an inlet opening 21*x* formed at its longitudinal end which is nearer to the inlet joints 2*a*-2*c*, that is, remote from the communication passage 23*x*, as shown in FIG. 5A. Through this inlet opening 21*x*, the first chamber 21 is held in communication with the connecting passage 7*c* (shown in FIG. 3A). The upper wall 21*a* provides a recessed portion 21*y* within the first chamber 21, as also shown in FIG. 5A. The recessed portion 21*y* is formed adjacent to the inlet opening 21*x*, so as to extend from the inlet opening 21*x* in the downstream direction. The recessed portion 21*y* functions to temporarily capture the air bubbles contained in the ink which has entered into the first chamber 21 through the inlet opening 21*x*, so that the air bubbles are prevented from flowing toward the filter 2*f*.

The above-indicated main space of the second chamber 22 has an inlet opening 22*x* formed at its longitudinal end which is nearer to the inlet joints 2*a*-2*c*, that is, remote from the communication passage 23*x*, as shown in FIG. 5B. Through this inlet opening 22*x*, the main space is held in communication with the connecting passage 7*a* (shown in FIG. 3A). As also shown in FIG. 5B, the main space of the second chamber 22 is held in communication with the above-indicated passage 22*e*, at its upper end and at its longitudinal end remote from the inlet opening 22*x*. At the end of the passage 22*e* remote from the main space, the passage 22*e* is held in communication with the communication passage 23*x*. The filter chamber 29 partially defined by the lower wall of the passage 22*e* and the end wall 22*d* of the main space has a parallelogram cross sectional shape as seen in the direction of arrangement of the two chambers 21, 22, as shown in FIG. 5B. The shape of the filter chamber 29 is substantially identical with the shape of the filter 2*f*, and the size of the filter chamber 29 is larger than that of the filter 2*f*.

Figure 5C:
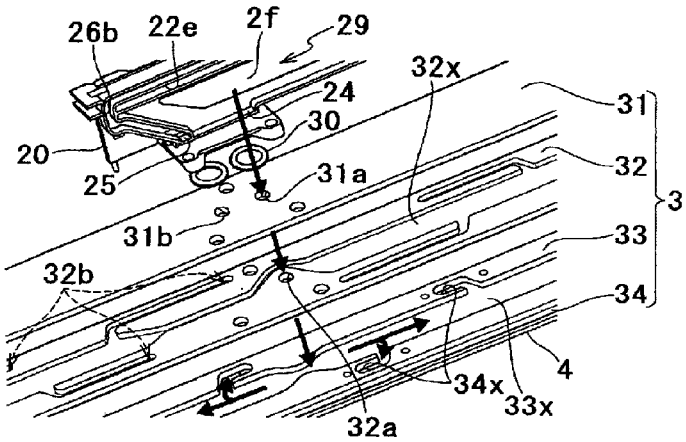

The partition wall 23 has an opening formed therethrough, at which the filter 2*f* is disposed such that the filter 2*f* is fixed at its peripheral portion to a portion of the partition wall 23 which defines the opening. The filter 2*f* is a meshed planar member configured to capture the foreign matters in the ink, and is fixed so as to extend in the vertical direction parallel to the surfaces of the partition wall 23. In this arrangement, the first chamber 21 and the filter chamber 29 are held in communication with each other through the mesh of the planar filter 2*f*. The base portion has a lower wall which partially defines the filter chamber 29 and which has a through-hole 24 through which the filter chamber 29 is held in communication with the through-hole 31*a* of the reservoir unit 3, as shown in FIG. 5C.

As shown in FIG. 5A, the planar filter 2*f* has a parallelogram shape as seen in the horizontal direction of arrangement of the first and second chambers 21, 22, which shape is substantially similar to that of the filter chamber 29. In the filter chamber 29, the filter 2*f* is positioned to be nearer to the lower wall 21*b* than to the upper wall 21*a*, in the vertical direction, so that an upper gap between the upper end of the filter 2*f* and the upper wall 21*a* is larger than a lower gap between the lower end of the filter 2*f* and the lower wall 21*b*. The larger upper gap prevents the filter 2*f* to capture and hold the air bubbles which have entered into the first chamber 21. The communication passage 23*x* is located between the upper wall 21*a* and the filter 2*f* in the vertical direction, and is lightly spaced from the filter 2*f* in the longitudinal direction of the base portion 20 away from the inlet openings 21*x*, 22*x*.

The exhaust passage 26*b* has an opening 26*x* at its end nearer to the inlet joints 2*a*-2*c*. Through this opening 26*x*, the exhaust passage 26*b* is held in communication with the connecting passage 7*b* (FIG. 3A). The base portion 20 has a through-hole 25 through which the exhaust passage 26*b* is held in communication with the through-hole 31*b* of the reservoir unit 3.

The partition wall 23 which has the opening at which the filter 2*f* is fixed, and the communication passage 23*x*, further has a through-hole 23*f* formed at an upper corner of the filter chamber 29, and a through-hole 23*g* communicating with the exhaust passage 26*b*. The filter chamber 29 is held in communication with the exhaust passage 26*a* through the through-hole 26*f*, while the exhaust passage 26*a* is held in communication with the exhaust passage 26*b* through the through-hole 26*g*.

Referring to FIGS. 5A-5C, the ink flows during the printing operation of the ink-jet head 1 will be described.

During the printing operation of the ink-jet head 1, the ink is delivered from the auxiliary tank 60 (FIG. 2) into the filter unit 2 through the inlet joint 2*c*, as indicated by arrows in FIG. 5A. Described in detail, the ink flows from the inlet joint 2*c* into the first chamber 21 through the connecting passage 7*c* (FIG. 3A) and the inlet opening 21*x*, and then flows through the first chamber 21 toward the filter 2*f*, as shown in FIG. 5A. The ink then flows from the first chamber 21 into the filter chamber 29 through the filter 2*f*, as shown in FIG. 5B, and enters into the reservoir unit 3 through the through-hole 24 and the through-hole 31*a*, as shown in FIG. 5C. The ink which has flown into the reservoir unit 3 through the through-hole 31*a* flows into the reservoir 33*x* through the through-hole 32*a*, and into the individual branch passages of the reservoir 33*x*. Subsequently, the ink flows into the passage unit 4 through the through-holes 34*x* and through-holes 4*x* (FIG. 4). The ink which has entered into the passage unit 4 through the through-holes 4*x* is distributed into the individual ink passages through the main manifold passages 41 and auxiliary manifold massages 41*a*, and is ejected from selected ones of the ink ejecting nozzles according to the operations of the actuator units 5 as well known in the art. These flows of the ink are naturally caused as the ink is consumed by the printing operation of the ink-jet head 1 to form the images on the paper sheets P. The through-holes 4*x* formed in the passage unit 4 are covered by respective filters (not shown). That is, the through-holes 34*x* and the through-holes 4*x* are held in communication with each other through this filter, so that the ink flows into the reservoir unit 3 into the passage unit 4 through the filter.

Figure 6A:
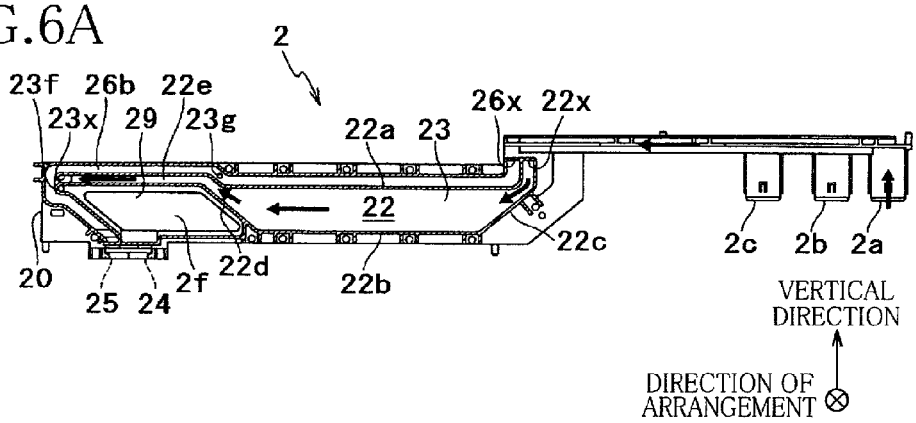
Figure 6B:
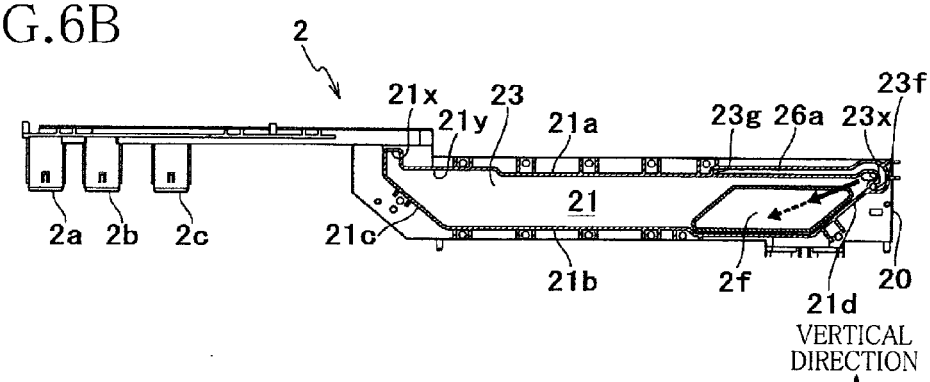
Figure 6C:
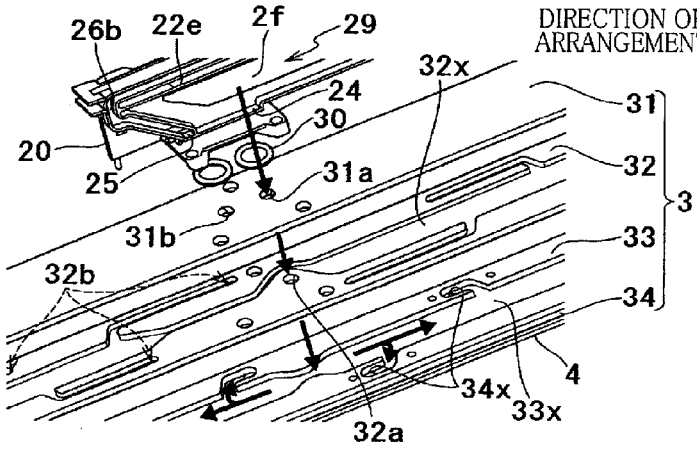

Referring next to FIGS. 6A-6C, the ink flows during the nozzle purging operation of the ink-jet head 1 will be described. The nozzle purging operation is performed to forcibly introduce the ink into the passage unit 4 and eject the ink from the nozzles, for the purpose of eliminating or preventing plugging of the nozzles with the ink. In other words, the nozzle purging operation is performed to discharge the ink having a relatively high degree of viscosity, from the nozzles, for thereby recovering the ink ejecting performance of the nozzles.

During the nozzle purging operation of the ink-jet head 1, the ink is delivered from the main tank 50 (FIG. 2) into the filter unit 2 through the inlet joint 2*a*, as indicated by arrows in FIG. 6A. Described in detail, the ink flows from the inlet joint 2*a* into the main space of the second chamber 22 through the connecting passage 7*a* (FIG. 3A) and the inlet opening 22*x*, and then flows through the main space and the passage 22*e*. Then, the ink flows from the passage 22*e* into the first chamber 21 through the communication passage 23*x*, as shown in FIG. 6B. The ink then flows which has entered into the first chamber 21 through the communication passage 23*x* flows into the filter chamber 29 through the filter 2*f*, and then into the reservoir unit 3 through the through-hole 24 and through-hole 31*a*, as shown in FIG. 6C. The ink then flows from the reservoir unit 3 into the passage unit 4, and is ejected from the nozzles, as described above with respect to the printing operation of the ink-jet head 1.

Figure 7A:
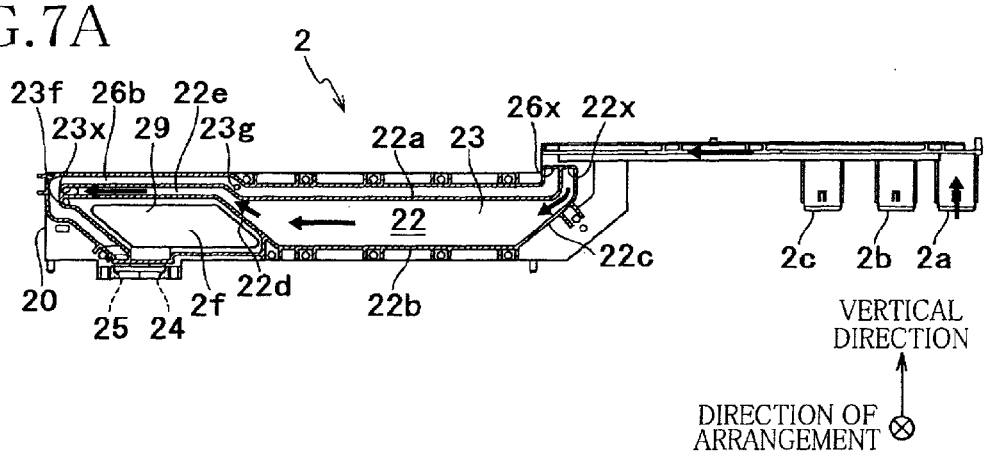
Figure 7B:
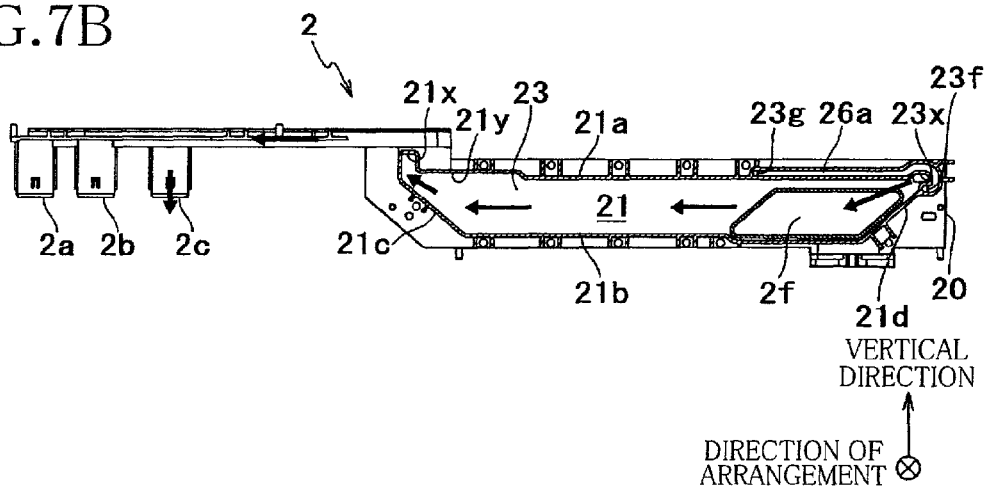

Referring next to FIGS. 7A and 7B, the ink flows during the circulation purging operation of the ink-jet head 1 will be described. The circulation purging operation is performed to forcibly introduce the ink into the filter unit 2 and remote the foreign matters deposited on the filter 2*f*, together with the ink, for the purpose of eliminating or preventing closing of the filter 2*f* with the foreign matters. In other words, the circulation purging operation is performed to effectively discharge the air bubbles and other foreign matters from a portion of the filter unit 2 upstream of the filter 2*f*, out of the ink-jet head 1.

During the circulation purging operation of the ink-jet head 1, the ink is delivered from the main tank 50 (FIG. 2) into the filter unit 2 through the inlet joint 2*a*, and into the communication passage 23*x*, as indicated by arrows in FIG. 7A, and as described above with respect to the nozzle purging operation. Then, the ink flows from the communication passage 23*x* into the first chamber 21, and flows along the surface of the filter 2*f* to the inlet opening 21*x*, as shown in FIG. 7B. The ink then flows through the inlet opening 21*x* and connecting passage 7*c* (FIG. 3A) into the auxiliary tank 60 through the inlet opening 2*c*.

Then, the ink flows during the inter-filter purging operation of the ink-jet head 1 will be described by reference to FIGS. 8A-8C. The inter-filter purging operation is performed to forcibly introduce the ink into the filter unit 2 and reservoir unit 3, for the purpose of removing the foreign matters accumulated between the filter 2*f* of the filter unit 2*f* and the filters disposed to cover the through-holes 4*x* open in the upper surface 4*b* (FIG. 4) of the passage unit 4, such that the foreign matters are discharged together with the ink from the ink-jet head 1.

Figure 8A:
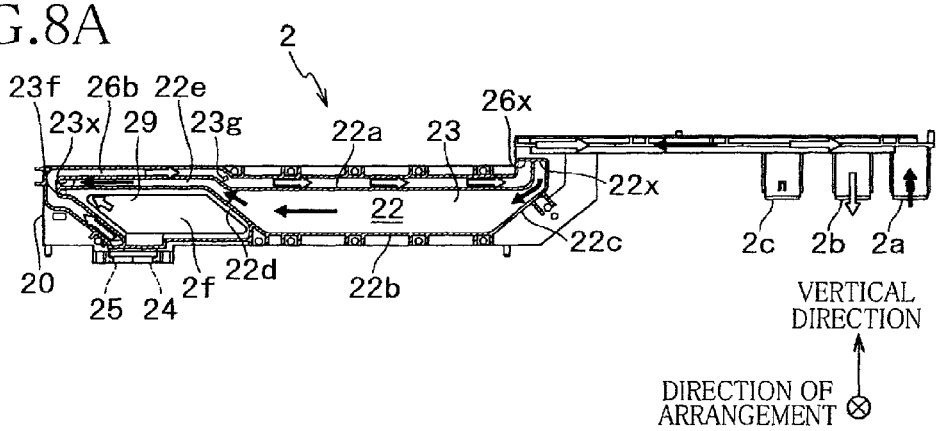

During the inter-filter purging operation of the ink jet head 1, the ink is delivered from the main tank 50 (FIG. 2) into the filter unit 2 through the inlet joint 2*a*, and into the communication passage 23*x*, as indicated by black-line arrows in FIG. 8A, and as described above with respect to the nozzle purging operation. Then, the ink flows from the communication passage 23*x* into the first chamber 21, as indicated by black-line arrow in FIG. 8B, and flows through the filter 2*f* into the filter chamber 29, as indicated by broken-line arrow in FIG. 8B and as described above with respect to the nozzle purging operation by reference to FIG. 6B. The ink flows from the filter chamber 29 into the reservoir unit 3 through the through-hole 24, as indicated by black-line arrows in FIG. 8C. The ink which has flown into the reservoir unit 3 through the through-hole 31*a* flows into the reservoir 33*x* through the through-hole 32*a*, and into the individual branch passages of the reservoir 33*x*. Subsequently, the ink flows toward the filters provided on the upper surface 4*b* of the passage unit 4.

Figure 8B:
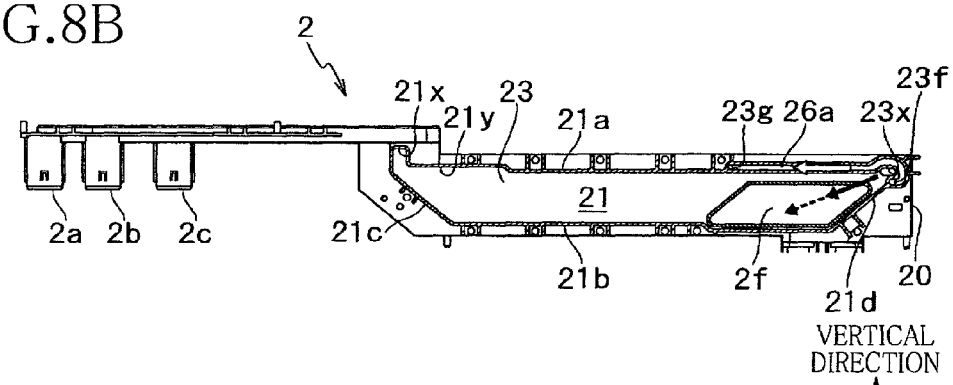
Figure 8C:
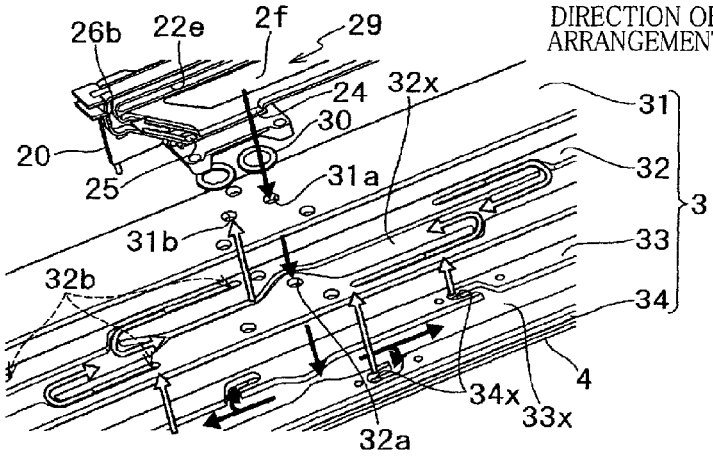

Then, the ink flows upwards through the through-holes 34*x* away from the filters on the upper surface 4*b*, and flows through the through-holes 32 in the end portions of the branch passages of the reservoir 33*x*, into the recess 32*x* from which the ink flows into the exhaust passage 26*b* through the through-hole 31*b* and through-hole 25, as indicated by white-line arrows in FIG. 8C. The ink which has flown into the exhaust passage 26*b* flows into the connecting passage 7*b* (FIG. 3A) through the opening 26*x*, as indicated by white-line arrows in FIG. 8A, and returns back to the auxiliary tank 60 (FIG. 2) through the inlet joint 2*b*.

The air bubbles existing in the filter chamber 29 float together on the mass of ink within the filter chamber 29 move together with the ink into the exhaust passage 26*a* through the through-hole 23*f* located at the upper corner of the filter chamber 29, and into an intermediate portion of the exhaust passage 26*b* through the through-hole 23*g*, as indicated by white-like arrows in FIGS. 8A and 8B. The ink which has entered into the exhausts passage 26*b* flows together with the air bubbles into the connecting passage 7*b* (FIG. 3A) through the opening 26*x*, and returns to the auxiliary tank 60 (FIG. 2) through the inlet joint 2*b*, as described above.

Each of the ink-jet heads 1 is controlled by the controller 501 (FIG. 1) of the printer 500 to perform the above-described printing operation, nozzle purging operation, circulation purging operation and inter-filter purging operation. In the present printer 500, the purging operations of each ink-jet head 1 are performed at a predetermined regular interval, or upon a predetermined manual operation by the user of the printer 500.

In the ink-jet head 1 constructed as described above according to the preferred embodiment of the invention, the filter 2*f* is disposed so as to extend in the vertical direction when the four ink-jet heads 1 are arranged in the horizontal direction in the printer 500. Accordingly, the filter 2*f* having an effective filtering surface area large enough to efficiently capture the foreign matters will not result in an increase in the size of the ink-jet head 1 in the horizontal direction. Further, unlike the filter disposed so as to extend in the horizontal direction, the present filter 2*f* disposed so as to extend in the vertical direction is unlikely to be clogged with the foreign matters over a large surface area, since the foreign matters contained in the ink tend to move upwards and float on the ink.

It is further noted that the filter 2*f* is disposed such that a suitable gap space is formed between the upper end of the filter 2*f* and the lower surface of the upper wall 21*a* of the first chamber 21, as shown in FIG. 5A, so that the foreign matters can be collected in the gap space above the filter 2*f*, whereby the foreign matters are unlikely to dwell adjacent to the filter 2*f*. Thus, the filter 2*f* is effectively protected against clogging with the foreign matters over a large surface area.

The communication passage 23*x* for communication between the first and second chambers 21, 22 is formed through a relatively upper portion of the partition wall 23, such that the communication passage 23*x* are open to the first and second chambers 21, 22, at vertical positions higher than the vertically middle portion of the chambers 21, 22, so that the foreign matters contained in the ink in the two chambers 21, 22 which tend to float upwards easily flow through the communication passage 23*x*, whereby the foreign matters can be effectively discharged through the communication passage 23, during the circulation purging operation described above by reference to FIGS. A and 7B.

The communication passage 23*x* is open to the first chamber 21, within the above-described gap space provided between the filter 2*f* and the upper wall 21*a* in the vertical direction, so that the foreign matters gathering above the filter 2*f* can be effectively discharged through the communication passage 23*x*, during the circulation purging operation described above by reference to FIGS. 7A and 7B.

During the circulation purging operation of the ink-jet head 1, the ink flows into and out of the first and second chambers 21, 22 through inlet and outlet openings that are located at vertical positions higher than the middle position of the chambers 21, 22 as seen in the vertical direction. Described more specifically, one of the opposite open ends of the communication passage 23*x*, and the inlet opening 21*x* respectively serve as the inlet and outlet for the first chamber 21, while the other open end of the communication passage 23*x* and the inlet opening 22*x* respectively serve as the inlet and outlet for the second chamber 22. These inlets and outlets that are located at the relatively higher positions of the chambers 21, 22 permit effective discharge of the foreign matters that gather in the upper gap space during the circulation purging operation.

The upper wall 21*a* of the first chamber 21 has the inlet opening 21*x* through which the ink is introduced into the first chamber 21 during the printing operation of the ink-jet head 1, and the recessed portion 21$y$ which extends from the inlet opening 21$x$ toward the filter 2$f$ in the downstream direction of the ink flow. During the printing operation, the foreign matters contained in the ink introduced into the first chamber 21 through the inlet opening 21$x$ gather in the recessed portion 21$y$1 and are therefore unlikely to reach the filter 2$f$. In the absence of the recessed portion 21$y$, the foreign matters existing in the upper part of the first chamber 21 may be mixed in the ink introduced into the first chamber 21 during the printing operation while the ink flows within the first chamber 21 toward the filter 2$f$, causing a risk of clogging of the filter 2$f$ with the foreign matters contained in the ink reaching the filter 2$f$. In the present ink-jet head 1 wherein the recessed portion 21$y$ is formed to retain the foreign matters therein, the ink flowing through the first chamber 21 is unlikely to flow with the foreign matters toward the filter 2$f$, whereby the filter 2$f$ is protected against clogging with the foreign matters during the printing operation.

Portions of the first chamber 21 adjacent to the inlet opening 21$x$ and the communication passage 23$x$ (serving as an outlet opening) are defined by the lower wall 21$b$, and the end walls 21$c$, 21$d$ which are inclined with respect to the lower wall 21$b$ by the respective obtuse angles θ1 and θ2, as seen in the direction of arrangement of the two chambers 21, 22. Similarly, portions of the main space of the second chamber 22 adjacent to the inlet opening 22$x$ and the passage 22$e$ (serving as an outlet opening) are partially defined by the lower wall 22$b$, and the end walls 22$c$, 22$d$ which are inclined with respect to the lower wall 22$b$ by the respective obtuse angles θ5 and θ6, as seen in the direction of arrangement of the two chambers 21, 22. If the angles of inclination θ1, θ2, θ5 and θ6 of the end walls 21$c$, 21$d$, 22$c$, 22$d$ with respect to the lower wall 21$b$, 22$b$ were 90 degrees, for example, collision of the ink flows with the lower wall 21$b$, 22$b$ would cause secondary ink flows in different directions other than the direction of ink flow from the inlet opening 21$x$, 22$x$ toward the outlet opening 23$x$, 22$e$, particularly when the velocity of the ink flows is relatively high. The secondary ink flows cause mixing of the air bubbles in the ink, and a pressure loss of the ink. The air bubbles once mixed in the ink due to the secondary ink flows are difficult to be released from the ink. The mixing of the air bubbles in the ink and the pressure loss cause a failure of normal ink ejection from the nozzles during the printing operation of the ink-jet head, and a failure of normal purging operations of the ink-jet head (a failure of normal discharge of the foreign matters by the purging operations). In the ink-jet head 1 according to the present invention, however, the angles of inclination θ1, θ2, θ5 and θ6 of the end walls 21$c$, 21$d$, 22$c$, 22$d$ with respect to the lower wall 21$b$, 22$b$ are determined to be obtuse angles, so as to prevent the generation of the secondary ink flows, and the consequent various problems described above.

Further, the upper wall 21$a$ and the end wall 21$c$ define the portion of the first chamber 21 adjacent to the inlet opening 21$x$ through which the ink flows into the first chamber 21 during the printing operation, and the upper wall 21$a$ and the end wall 21$d$ define the portion of the first chamber 21 adjacent to the communication passage 23$x$ through which the ink flows from the first chamber 21 during the nozzle, circulation and inter-filter purging operations. The end walls 21$c$, 21$d$ are inclined with respect to the upper wall 21$a$ by the angles θ3 and θ4 of about 40 degrees as seen in the direction of arrangement of the two chambers 21, 22. Similarly, the upper wall 22$a$ and the end wall 22$c$ define the portion of the main space of the second chamber 22 adjacent to the inlet opening 22$x$ through which the ink flows into the second chamber 22 during the purging operations. The end wall 22$c$ is inclined with respect to the upper wall 22$a$ by the angle θ7 of about 40 degrees. These angles of inclination θ3, θ4 and θ7 also contribute to prevention of the generation of the secondary ink flows and consequent various problems.

The filter 2$f$ has the parallelogram shape as seen in the direction of arrangement of the two chambers 21, 22. This parallelogram shape of the filter 2$f$ is partially defined by the upper wall 21$a$, end wall 21$d$ and lower wall 21$b$ which are formed such that the end wall 21$d$ connecting the upper and lower walls 21$a$ and 21$b$ is inclined with respect to the lower wall 21$b$ by the obtuse angle of θ2 as seen in the direction of arrangement of the two chambers 21, 22. Unlike a circular, rectangular or any other shape the front and back surfaces of which are seen to be symmetrically identical with each other in the opposite directions, the parallelogram shape of the filter 2$f$ has the front and back surfaces having symmetrically different shapes as seen in the opposite directions, so that the filter 2$f$ can be easily fixed in the filter unit 2, with its front and back surfaces facing in the right directions.

Each of the first and second chambers 21, 22 is partially defined by the vertically extending wall including the flexible film 27 opposed to the partition wall 23 in the direction of arrangement of the two chambers 21, 22, as shown in FIG. 3B. The flexible films 27 function to reduce the amount of variation of the ink pressure within the first and second chambers 21, 22. Namely, the flexible films 27 have a pressure damping effect with respect to the ink within the chambers 21, 22. Further, the flexible films 27 which extend in the vertical direction can be given a surface area large enough to effectively perform the pressure damping effect, without a considerable increase of the size of the ink-jet head in the horizontal direction.

Further, the flexible film 27 of each chamber 21 is backed by the metal sheet 28 formed such that the flexible film 27 is interposed between the partition wall 23 and the flexible film 27 in the direction of arrangement of the two chambers 21, 22, as also shown in FIG. 3B. The metal sheet 28 functions as a rigid sheet member to prevent a damage of the flexible film 27.

The partition wall 23 and the first and second chambers 21, 22 have larger horizontal dimensions than vertical dimensions, as seen in the direction of arrangement of the two chambers 21, 22, as is apparent from FIGS. 5A and 5B. Accordingly, the ink flows through the first and second chambers 21, 22, during the circulation purging operations, for example, in the longitudinal directions of the chambers 21, 22, as indicated in FIGS. 7A and 7B. Thus, the ink flows through the first and second chambers 21, 22 by a relatively long distance in the horizontal direction, so that the foreign matters are likely to be captured in the chambers 21, 22 before the foreign matters reach the ink ejecting nozzles, and discharged from the ink-jet head 1 during the circulation purging operation.

Further, each chamber 21, 22 has a rectangular cross sectional shape as seen in the direction perpendicular to the direction of arrangement of the chambers 21, 22, having a larger dimension in the vertical direction than a horizontal dimension in the direction of arrangement, as shown in FIG. 5B. Accordingly, the four ink-jet heads 1 can be arranged in the secondary scanning direction, at a relatively small pitch of arrangement, as shown in FIG. 1, so that the printer 500 can be accordingly small-sized. In addition, the small pitch of arrangement of the ink-jet heads 1 requires a reduced distance of feeding of the paper sheet P from the moment of starting and finishing of the image printing operation on the paper sheet P, and accordingly permits an increased efficiency of the image printing operation, and an improvement of the image quality owing to a reduced chance of dislocation of ink dots of different colors corresponding to the four ink-jet heads 1.

While the preferred embodiment of the present invention has been described above by reference to the drawings, for illustrative purpose only, it is to be understood that the present invention is not limited to the details of the illustrated embodiment, but may be embodied with various changes and modifications, which may occur to those skilled in the art, without departing from the spirit and scope of the invention defined in the appended claims.

In the illustrated embodiment, the principle of the present invention applies to a liquid-flow space through which a liquid in the form of the ink flows and which is partially defined by a partition portion in the form of the partition wall 23 in the filter unit 2 superposed on the reservoir unit 3. However, the principle of the invention is equally applicable to any liquid-flow space formed in a portion of in the ink-jet head 1 other than the filter unit 2.

Although the filter 2*f* of the ink-jet head 1 according to the illustrated embodiment is disposed so as to extend in the vertical direction, the filter may be disposed so as to extend in any direction which intersects the horizontal direction and which is inclined with respect to the vertical direction.

In the illustrated embodiment, the partition portion in the form of the partition wall 23, and the first and second chambers 21, have larger dimensions in the horizontal direction, as seen in the direction of arrangement of the two chambers 21, 22. However, the partition portion and the two chamber 21, 22 may have larger dimensions in the vertical direction, provided the filter is disposed so as to extend in a direction intersecting the horizontal direction, for reducing an increase in the size of the ink-jet head in the horizontal direction and a chance of clogging of the filter with the foreign matters over a large surface area.

The printer 500 including the ink-jet heads 1 according to the preferred embodiment has been described above, with the particular directions of ink flows through the first and second chambers 21, 22 during the printing and purging operations, particular positions of the ink inlet and outlet openings (including the communication passage 23*x*) of the chambers 21, 22, and particular positions of the ink inlet and outlet passages with respect to the chambers 21, 22. However, each ink-jet head 1 may be otherwise configured. In the illustrated embodiment wherein the first and second chambers 21, 22 are elongate in the horizontal direction as seen in the direction of arrangement of the two chambers 21, 22, the ink flows through the first and second chambers 21, 22 in the horizontal direction parallel to the longitudinal direction of the chambers 21, 22 from the ink inlet opening at one end of each elongate chamber to the ink outlet opening at the other end. However, the chambers may be formed so that the ink flows in the vertical direction.

Further, the ink-jet head may be configured such that the ink flows in a direction different from the longitudinal direction of the two chambers (as seen in the direction of arrangement of the two chambers), that is, may flow in the direction perpendicular to the longitudinal direction. It is also noted that the recessed portion 21*y* defined by the upper wall 21*a* of the first chamber 21 may be eliminated. Although the communication passage 23*x* for communication between the first and second chambers 21, 22 are open at a vertical position between the filter 2*f* and the upper walls 21*a*, 22*a* in the illustrated embodiment, the communication passage 23*x* may be replaced by a communication passage open at a position within the vertical dimension of the filter, or at a position below the filter.

In the illustrated embodiment, the first and second chambers 21, 22 have an inverted trapezoidal cross sectional shape as seen in the direction of arrangement of the two chambers 21, 22, as shown in FIG. 5A However, the shape of the first and second chambers 21, 22 is not limited to the inverted trapezoidal shape. Further, the angles of inclinations θ1-θ8 (indicated in FIGS. 5A and 5B) of the end walls 21*c*, 21*d*, 22*c*, 22*d* with respect to the upper and lower walls 21*a*, 21*b*, 22*a*, 22*b* may be suitably determined.

In the illustrated embodiment, the filter 2*f* has a parallelogram shape as seen in the direction of arrangement of the two chambers 21, 22, as shown in FIG. 6A. However, the shape of the filter 2*f* is not limited to the parallelogram shape. Further, the filter 2*f* disposed below the upper wall 21*a* in the illustrated embodiment may be disposed in contact with the upper wall 21*a*.

While the filter 2*f* is disposed in the second chamber 22, the filter 2*f* may be disposed in the second chamber 22, or two filters may be provided in the respective two chambers 21, 22.

In the illustrated embodiment, each of the side walls of the first and second chambers 21, 22 opposed to each other in the direction of arrangement of the two chambers 21, 22 is a laminar structure consisting of the flexible film 27 and the metal sheet 28, as shown in FIG. 3B. However, each side wall may consist of only the flexible film 27, or any other member. The metal sheet 28 is an example of a rigid member, and may be replaced by any rigid member other than a metallic member.

In the illustrated embodiment, both of the side walls of the first and second chambers 21, 22 opposed in the direction of arrangement of the two chambers 21, 22 are provided with the flexible film 27 and the metal sheet 28, as shown in FIG. 3B. However, only one of the opposite side walls may be provided with the flexible film 27, or the metal sheet 28.

The liquid ejecting head according to the present invention may be of either a line printing type or a serial printing type, and may be used in an apparatus other than the printer, for example, in a facsimile or copying apparatus. The liquid ejecting head of the invention may use a liquid other than an ink.

Although the ink-jet head 1 according to the illustrated embodiment of this invention uses the piezoelectric actuator units 5 configured to eject the liquid from the nozzles, the ink-jet head may use other types of actuator such as an electrostatic type and a resistor-heating thermal type.

What is claimed is:

1. A liquid ejecting head comprising:

a structure defining a liquid-flow space through which a liquid flows from a liquid supply source toward a plurality of liquid-drop ejecting nozzles;

a generally planar partition portion formed so as to extend along a vertical direction and a first direction each intersecting a second direction and configured to partially define the liquid-flow space;

the partition portion partially defining a first chamber and a second chamber such that the first and second chamber are arranged in the second direction on respective opposite sides of the partition portion, the first and second chambers having a larger dimension in the vertical direction than that in the second direction, in cross section taken in a plane parallel to the vertical direction and the second direction of arrangement of the first and second chambers; and a planar filter fixed to the partition portion so as to extend along the vertical direction and the first direction, along a surface of the partition portion, and configured to capture foreign matters contained in the liquid in the first chamber, wherein the structure defines a filter chamber with the filter positioned between the first chamber and the filter chamber in the second direction, wherein the filter chamber does not directly communicate with the second chamber, wherein the structure defines a first opening through which the liquid flows into the first chamber during a circulation purging operation, and further defines a second opening through which the liquid flows out of the first chamber during the circulation purging operation, the first opening being located at one side of the filter in the first direction and the second opening being located at the other side of the filter in the first direction, wherein the liquid flows along the filter in the first chamber during the circulation purging operation and, wherein, during the printing operation of the liquid ejecting head to eject droplets of the liquid from the liquid-drop ejecting nozzles, the liquid flows into the first chamber through the second opening and flows to the filter chamber through the filter.

2. The liquid ejecting head according to claim 1, wherein the filter is disposed below an upper wall of the first chamber such that a gap space is formed between the filter and the upper wall.

3. The liquid ejecting head according to claim 2, wherein the upper wall of the first chamber extends in a substantially first direction.

4. The liquid ejecting head according to claim 1, further comprising another structure defining a communication passage for communication between the first chamber and the second chamber, and a vertical position at which the communication passage is open to the first chamber is higher than a vertically middle portion of the first chamber.

5. The liquid ejecting head according to claim 2, further comprising another structure defining a communication passage for communication between the first chamber and the second chamber, and a vertical position at which the communication passage is open to the first chamber is located between the filter and the upper wall in the vertical direction.

6. The liquid ejecting head according to claim 5, wherein the communication passage is a through-hole formed through a portion of the partition portion between the filter and the upper wall in the vertical direction.

7. The liquid ejecting head according to claim 5, wherein the first opening is an opening of the communication passage in the first chamber.

8. The liquid ejecting head according to claim 1, wherein the first chamber is defined by an upper wall partially defining a recessed portion which extends in the first direction, the recessed portion being located between the first opening and the filter in the first direction.

9. The liquid ejecting head according to claim 1, wherein the first chamber is defined by a lower wall, and an end wall inclined with respect to the lower wall by an obtuse angle as seen in the second direction of arrangement of the first and second chambers.

10. The liquid ejecting head according to claim 1, wherein the first chamber is defined by an upper wall, a lower wall parallel to the upper wall, and an end wall which connects the upper and lower walls and which is inclined with respect to the lower wall by an obtuse angle as seen in the second direction of arrangement of the first and second chambers, and the filter has a parallelogram shape as seen in the second direction of arrangement of the two chambers.

11. The liquid ejecting head according to claim 1, wherein the first chamber is partially defined by a side wall which is opposed to the partition portion in the second direction of arrangement of the first and second chambers and which includes a flexible film extending in the vertical direction and the first direction.

12. The liquid ejecting head according to claim 11, wherein the side wall further includes a rigid sheet member formed to back the flexible film such that the flexible film is interposed between the partition portion and the rigid sheet member.

13. The liquid ejecting head according to claim 1, wherein the partition portion, and the first and second chambers have larger dimensions in the first direction than in the vertical directions, as seen in the second direction of arrangement of the first and second chambers, and the liquid flows through the first and second chambers in the first directions of the first and second chambers as seen in the second direction of arrangement of the first and second chambers.

14. The liquid ejecting head according to claim 1, further comprising a lowermost structure having a substantially horizontally extending liquid-drop ejecting lower surface in which the plurality of liquid-drop ejecting nozzles are open.

15. The liquid ejecting head according to claim 7, wherein the liquid in the second chamber flows into the first chamber through the communication passage in the circulation purging operation.

* * * * *